US005203261A

United States Patent [19]

Davis

[11] Patent Number: 5,203,261

[45] Date of Patent: Apr. 20, 1993

[54] CAN BALING MACHINE AND METHOD

[75] Inventor: Robert M. Davis, Bonita, Calif.

[73] Assignee: CP Manufacturing, Inc., National City, Calif.

[21] Appl. No.: 788,331

[22] Filed: Nov. 5, 1991

[51] Int. Cl.[5] ..... B30B 9/32; B30B 7/04

[52] U.S. Cl. ..... 100/42; 100/50; 100/98 R; 100/215; 100/218; 100/232; 100/249; 100/902

[58] Field of Search ..... 100/42, 50, 52, 232, 100/240, 245, 246, 253, 902, 94, 95, 96, 98 R, 141, 142, 188 R, 207, 218, 249, 901, 179, 215

[56] References Cited

U.S. PATENT DOCUMENTS

| | | | |
|---|---|---|---|
| 3,005,403 | 10/1961 | Van Endert | 100/901 |
| 3,129,656 | 4/1964 | Judd | 100/95 |
| 3,384,007 | 5/1968 | Bose | 100/188 R |
| 3,501,890 | 3/1970 | Hunt | 100/188 R |
| 3,613,556 | 10/1971 | Wright | 100/50 |
| 3,802,337 | 4/1974 | St. Hiliare | 100/245 |
| 3,838,633 | 10/1974 | Newell | 100/42 |
| 3,908,538 | 9/1975 | Boyd | 100/269 R |
| 4,096,799 | 6/1978 | Zupancic | 100/232 |
| 4,121,515 | 10/1978 | Tea | 100/232 |
| 4,134,335 | 1/1979 | O'Rourke | 100/179 |
| 4,417,510 | 11/1983 | Sharp | 100/232 |
| 4,541,332 | 9/1985 | Horansky | 100/42 |
| 4,601,238 | 7/1986 | Davis | 100/45 |
| 4,787,308 | 11/1988 | Newsom | 100/232 |
| 5,007,337 | 4/1991 | Newsom | 100/232 |

FOREIGN PATENT DOCUMENTS

| | | | |
|---|---|---|---|
| 1069699 | 7/1954 | France | 100/142 |
| 2184979 | 7/1987 | United Kingdom | 100/232 |

*Primary Examiner*—Philip R. Coe
*Assistant Examiner*—Randall E. Chin
*Attorney, Agent, or Firm*—Brown, Martin, Haller & McClain

[57] ABSTRACT

A baling machine has an outer housing forming an elongate, rectangular main baling chamber with a discharge opening at one end and an auxiliary baling chamber intersecting the main baling chamber. An inlet opening directs cans into the chambers at the intersection. An auxiliary piston is reciprocally mounted in the auxiliary baling chamber to compress cans to a first compression pressure in an initial compaction stage, while a main piston is reciprocally mounted in the main baling chamber to compress the compacted cans to a second compression pressure in a final compaction stage in which a bale of predetermined dimensions and weight is formed without any need for pre-weighing the cans.

7 Claims, 4 Drawing Sheets

CAN BALING MACHINE AND METHOD

CROSS-REFERENCE TO RELATED APPLICATION

This application is related to my co-pending application entitled "Ram Apparatus", which was filed on even date herewith.

BACKGROUND OF THE INVENTION

The present invention relates generally to a machine and method for forming cans and similar articles into rectangular, self-sustaining bales for re-cycling.

In current can crushing machines, such as that described in U.S. Pat. No. 4,601,238 of Davis et al., a quantity of cans is fed into a rectangular baling chamber and a large, heavy piston is moved by an hydraulic drive ram back and forth in the chamber to compress the cans to a block or bale of the desired size. In order to ensure that the block is of a standard weight and size, the cans are normally weighed before feeding them into the baling chamber. Another option is to use the compacting piston to sense through the pressure it has to exert on the cans whether the correct can density has been reached. In other words, the cans are compressed until a predetermined compression pressure is reached. One problem with this option is that cans fed into the baling chamber will be in a wide range of different conditions, from non-compacted to partially compacted and completely compacted. The compacting piston is heavy and slow, and typically requires a number of strokes to compress the mass of cans to the predetermined pressure. At this point, the bale may or may not be the correct size, in view of the different initial degrees of compaction of the cans. If the bale is not the right size, the piston must be retracted again to allow more cans to fall into the chamber, and these must be compressed with the original cans until a bale of the correct dimensions is made.

Since the piston must apply a substantial compressive force, its hydraulic drive has a very large oil capacity and requires a considerable amount of time to make each thrust. A large number of thrusts are required to perform the initial compaction, making the can baling process slow and therefore relatively expensive.

SUMMARY OF THE INVENTION

It is an object of the present invention to provide a new and improved can baling machine and method.

According to one aspect of the present invention, a can baling machine is provided, which comprises an outer housing having an elongate, rectangular main baling chamber and an elongate auxiliary baling chamber intersecting the main baling chamber. An inlet opening is provided for supplying cans to the baling chambers at their intersection. The main baling chamber has a discharge opening at one end which is normally closed by a door. A main piston is reciprocally mounted in the main baling chamber, and is moveable back and forth by an actuator towards the discharge opening in an initial compression stage to compress the cans a predetermined amount prior to actuation of the main piston. An auxiliary piston is reciprocally mounted in the auxiliary baling chamber and is moveable by an auxiliary actuator towards the main baling chamber in a compression stroke. A first sensing device senses when the auxiliary piston has compressed cans in the intersection to a predetermined first compression pressure, and a system controller activates the main piston when the first compression pressure is reached. A second sensing device senses when the main piston has compressed cans to a predetermined second compression pressure greater than the first compression pressure. The dimensions of the cavity in the main baling chamber between the main piston and discharge opening are such that when a supply of cans compressed to the first compression pressure fills the cavity, they will be of the predetermined, desired bale weight and size when compressed to the second compression pressure by the main piston.

This arrangement allows cans to be compressed to a bale of predetermined size and weight without any need for pre-weighing the cans, and without any problems resulting from the cans initially being in different stages of compaction.

In a preferred embodiment of the invention, the auxiliary chamber is perpendicular to the main baling chamber to form a generally T-shaped intersection, and the discharge opening is directed downwardly perpendicular to the intersection, so that cans fill the available space in the auxiliary and main chamber. The auxiliary piston is of lower power than the main piston, and can operate much faster to provide the initial compression pressure, for example to around $\frac{1}{3}$ of the desired final pressure.

According to another aspect of the present invention, a method of compressing cans into bales of predetermined weight and dimensions is provided, which comprises the steps of feeding cans into a cavity at the intersection between a main baling chamber and an auxiliary baling chamber, operating an auxiliary piston in the auxiliary baling chamber to compress the cans in the cavity until a predetermined first compression pressure is reached, stopping the auxiliary piston when the first compression pressure is reached and operating a main piston in the main baling chamber to compress the cans farther towards a discharge end of the baling chamber until a predetermined second compression pressure is reached, and opening a door at the discharge end of the baling chamber and discharging the bale of cans when the second compression pressure is reached.

This apparatus and method allows a bale of cans to be made much more quickly and efficiently than was possible previously, without the need for a pre-weighing step or measurement of the formed bale and without the need for a large, slow-moving main piston to perform all of the compression strokes.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
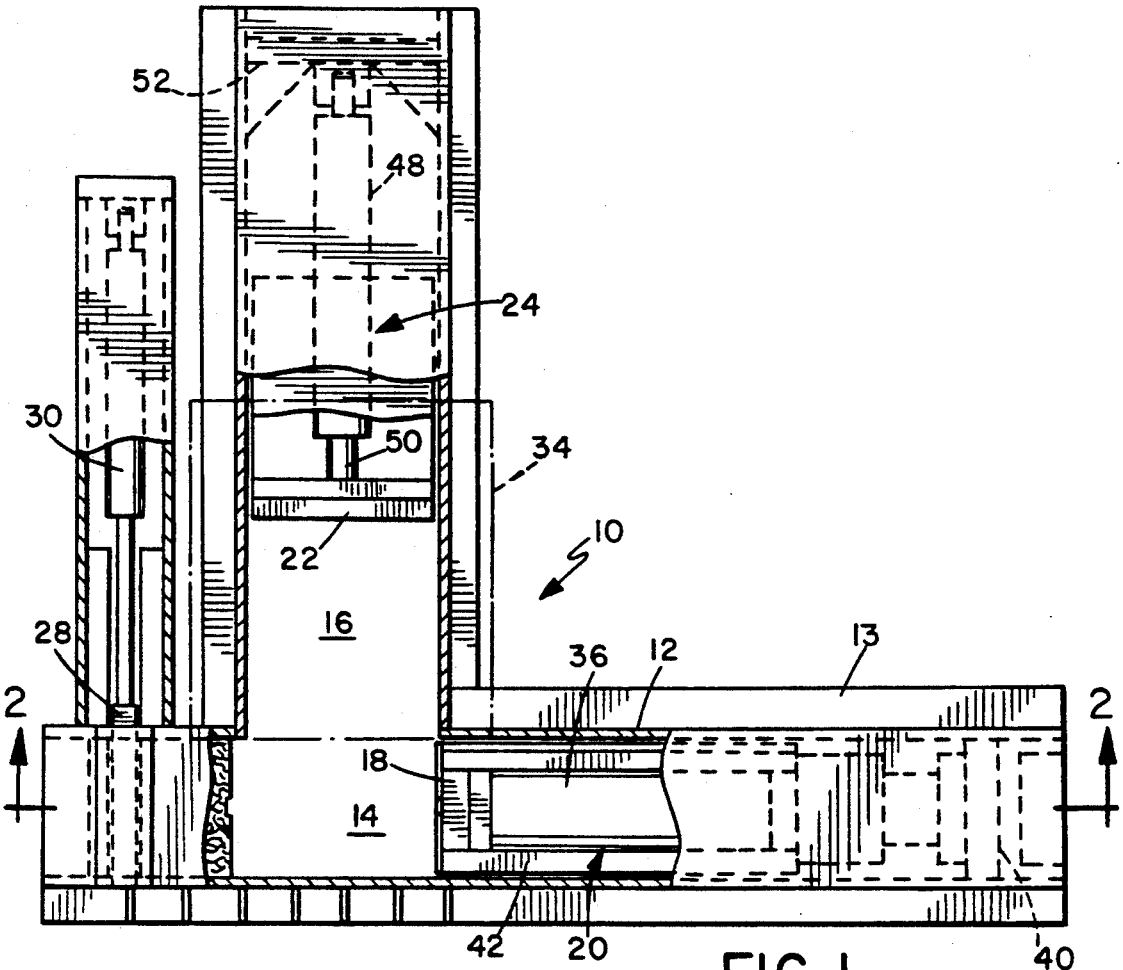
FIG. 1 is a top plan view of a can baling or packing machine according to a preferred embodiment of the invention, with portions cut away.

The drawings illustrate a can baling machine 10 according to a preferred embodiment of the present invention. The machine 10 basically comprises an outer housing or casing 12 with an enlarged base 13, the casing having an elongate, rectangular main baling chamber 14 and an elongate auxiliary baling chamber 16 intersecting the main chamber 14 to form a generally T-shaped cavity. A main plunger or piston 18 is reciprocally mounted in the main baling chamber 16 and is operated by means of a large hydraulic ram or actuator 20. An auxiliary plunger 22 of lower thrust than the main plunger or piston 18 is reciprocally mounted in the auxiliary baling chamber and is operated by means of an auxiliary hydraulic ram or actuator 24.

Figure 2:
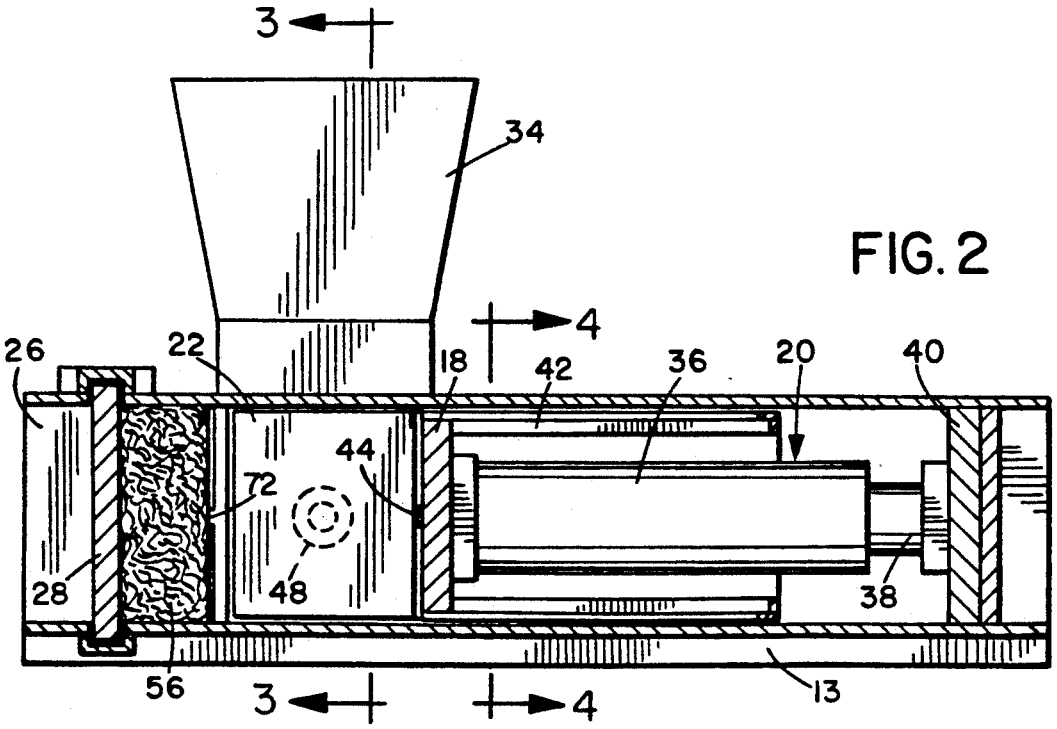
FIG. 2 is a sectional view taken on line 2—2 of FIG. 1.
Figure 3:
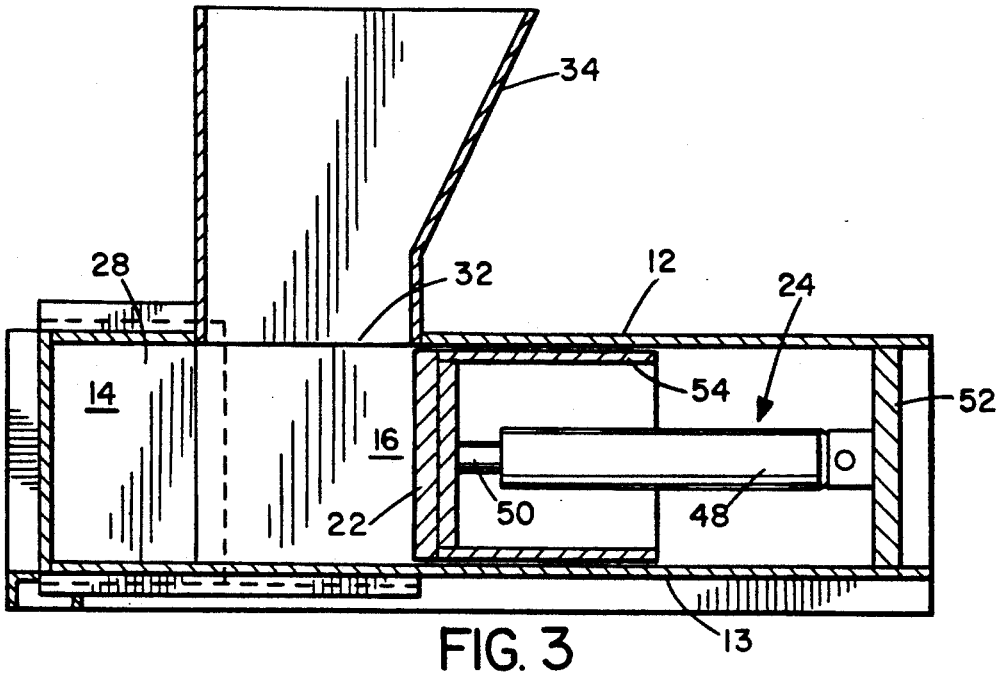
FIG. 3 is a sectional view taken on line 3—3 of FIG. 2.

The main baling chamber 14 has a discharge opening 26 at one end which is normally closed by retractable door 28. Door 28 is operated to move between the closed position illustrated in FIGS. 1 and 6 and the open position illustrated in FIG. 8 by means of hydraulic piston and cylinder actuator 30. Chamber 14 has an upper, inlet opening 32 at the junction between the main and auxiliary baling chambers, as best illustrated in FIGS. 2 and 3, and a suitable hopper 34 is mounted at the inlet opening for feeding cans into the chamber 14. Cans will be fed into hopper 34 from a suitable feeding device or conveyor, as is known in the field.

Figure 4:
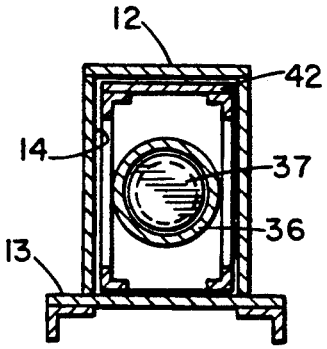
FIG. 4 is a sectional view taken on line 4—4 of FIG. 2.
Figure 5:
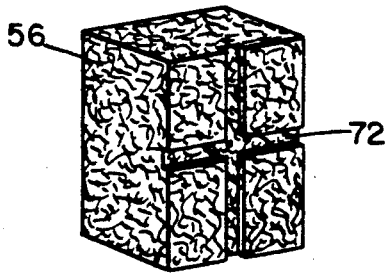
FIG. 5 illustrates a typical bale of compressed cans as produced by the machine.

Hydraulic actuator 20 is designed to operate up to relatively high pressures of the order of 3000 p.s.i. As best illustrated in FIGS. 2 and 4, actuator 20 comprises an outer cylinder or ram barrel 36 secured to piston or plunger head 18, and a piston 37 slidably mounted in the barrel with a shaft or rod 38 secured to the piston extending out of the opposite end of the barrel and anchored to the closed end 40 of chamber 14. Hydraulic actuator 20 preferably comprises a ram apparatus as described in my co-pending application filed on even date herewith and entitled "Ram Apparatus". Ram barrel 36 is supported in an outer, elongate rectangular support frame or box 42 which is a sliding fit in the chamber 14, taking the stress off ram barrel 36 and reducing the risk of the shaft bending under high pressure. Support frame 42 will also ensure that head 18 is accurately centered. A cruciform shape rib 44 is formed on the face of plunger 18 for forming a correspondingly shaped groove in the can bale, as will be explained in more detail below.

Hydraulic actuator or ram 24 is of smaller capacity than actuator 20 and comprises a relatively small diameter ram cylinder or barrel 48 in which a piston secured to piston shaft 50 is slidably mounted. In one specific example of the invention, ram barrel 48 had a diameter of 4 inches while main ram barrel 36 had a diameter of 10 inches or 2.5 times that of the ram barrel 48. Piston shaft 50 extends out of the barrel 48 and is secured to piston head 22 at its free end. The closed end of barrel 48 is secured to the closed end 52 of the auxiliary baling chamber 16, as best illustrated in FIG. 3. Piston head 22 has a rearwardly extending support skirt or frame 54 for centering the piston and actuator during operation.

Figure 6:
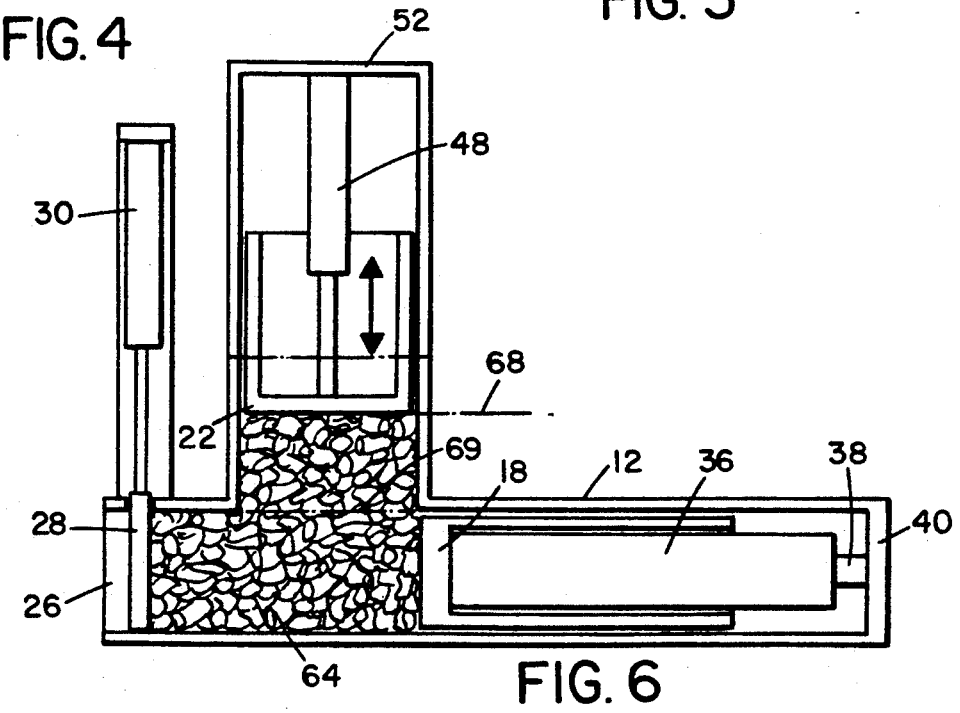
FIG. 6 is a diagrammatic top plan view of the machine illustrating the initial pre-compression action.
Figure 7:
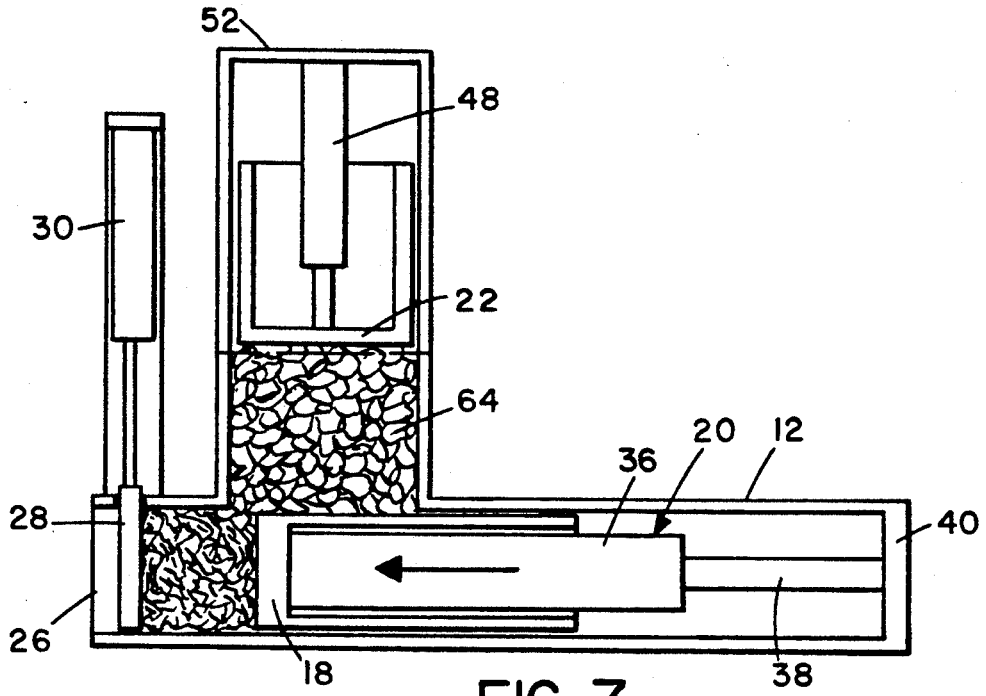
FIG. 7 is a similar view illustrating the final compression action.
Figure 8:
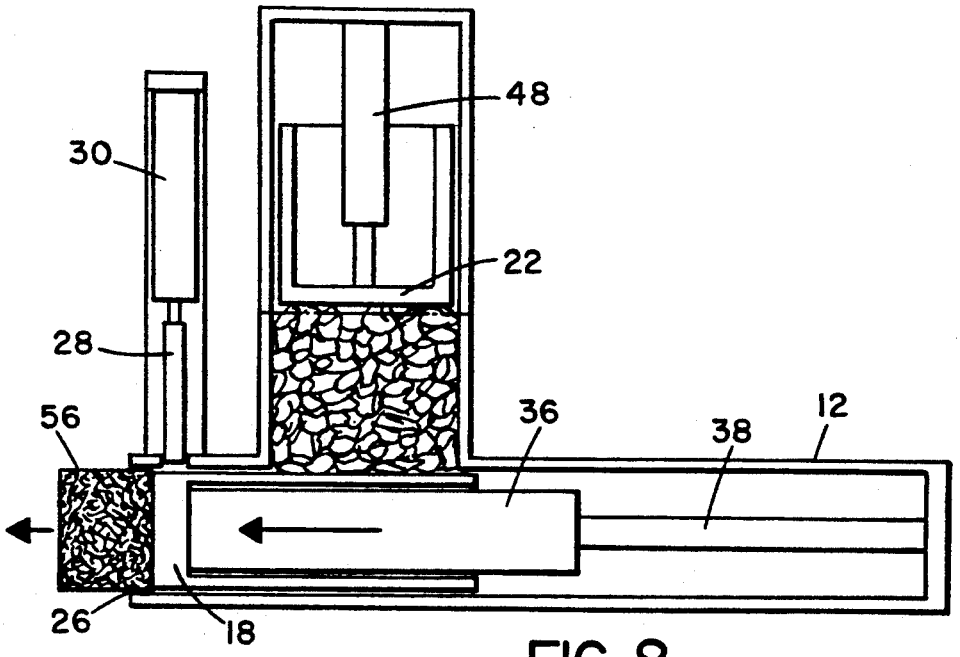
FIG. 8 is a similar view illustrating ejection of the completed bale.
Figure 9:
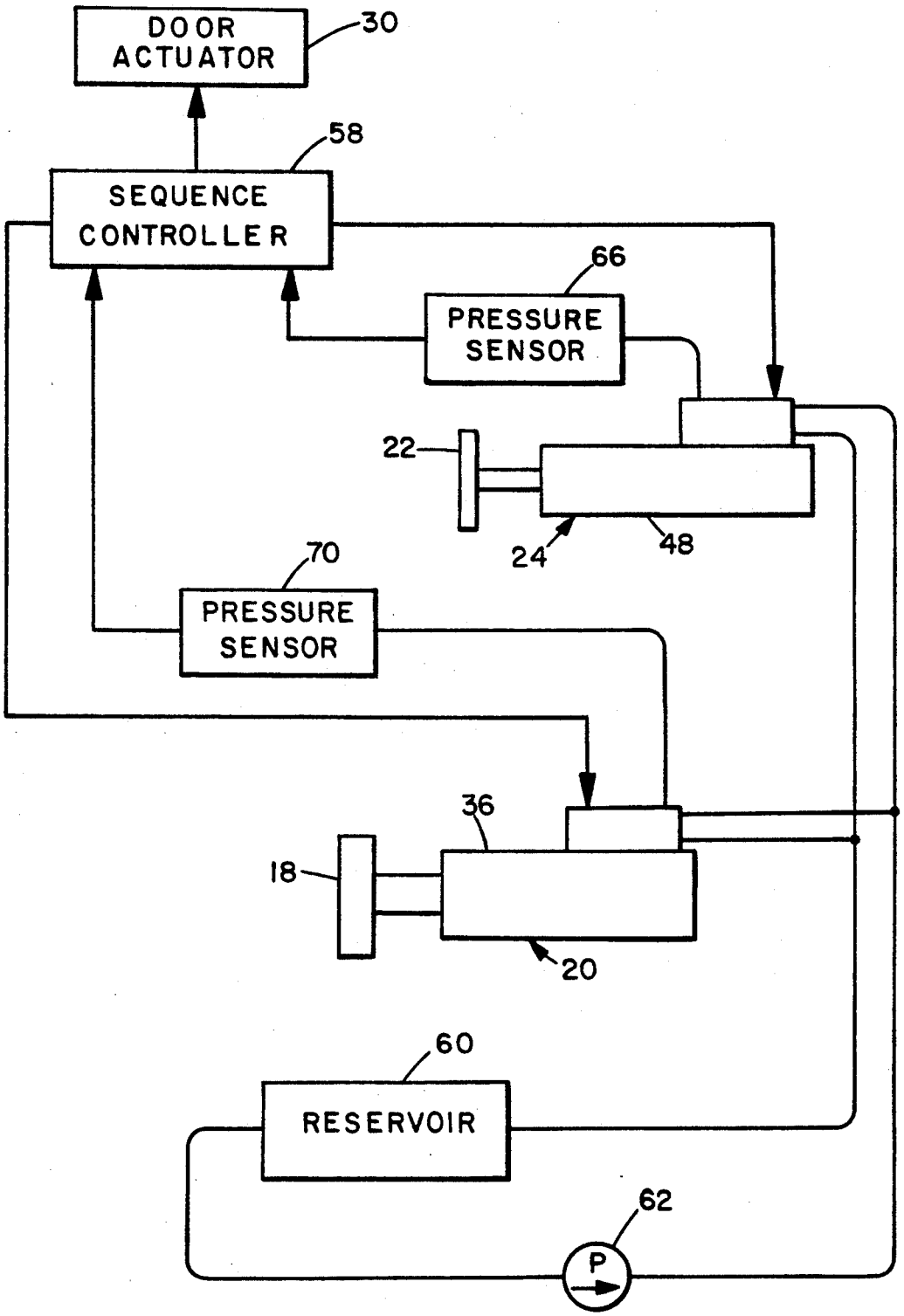
FIG. 9 illustrates schematically the operating system of the machine.

The main baling chamber 14 is of predetermined dimensions dependent on the size of bale to be produced. The operating sequence for producing a bale 56 of crushed cans of predetermined dimensions and weight is illustrated in FIGS. 6 to 8, while FIG. 9 is a schematic illustration of the operating system. Both of the hydraulic actuators 20 and 24 are operated under the control of sequence controller 58, which controls the supply of hydraulic fluid from reservoir 60 via pump 62 to the respective ram barrels 36 and 48.

Cans 64 at various stages of compaction are initially supplied to the intersection between the two baling chambers via hopper 34, with both pistons in their fully retracted positions illustrated in both FIGS. 1 and 6, as illustrated in FIG. 1. The end of piston 18 is aligned with a first side wall of chamber 16 in the retracted position, and the resultant L-shaped cavity extending across the intersection between the chambers from the auxiliary baling chamber to the main baling chamber will be filled with cans, as illustrated in FIG. 6. Once the cavity has been filled with cans 64, the auxiliary hydraulic actuator 24 is activated under the control of controller 58 to reciprocate the piston head 22 back and forth, as indicated by the arrow in FIG. 6, compressing cans downwardly in the shaped cavity towards the portion of the cavity formed between the main baling piston 18 and the door 28. Because the ram cylinder 48 is relatively small, it can be filled relatively quickly and the piston head 22 is capable of rapid movement. Actuator 24 is operated to move piston head 22 back and forth to compact the cans until a suitable sensing device 66 in ram cylinder 48 detects that a predetermined compression pressure has been reached. In other words, the pressure which the piston head 22 has to exert to compress the cans will increase as the cans become more compressed, and this pressure will therefore be dependent on the degree of compression, or compaction, of the cans. When this compression pressure has been reached, the cans will be compressed down to approximately line 68 in the auxiliary baling chamber 16.

At this point, the auxiliary actuator is stopped and the main actuator is actuated to reciprocate main piston 18 back and forth between the retracted position of FIG. 1 and 6 and the advanced position to compress cans towards the discharge end of the baling chamber. Only a relatively short compression stroke is needed in view of the initial compression applied by piston 22. Piston 18 will act to shear off the cans within the cavity along the line 69 from the cans remaining in auxiliary chamber 16, driving the cans in chamber 14 towards the door 28, as illustrated in FIG. 7. A second sensing device 70 in ram cylinder 36 detects when the cans have been compressed by piston 18 to a second, higher compression pressure by the pressure which the piston has to exert on the cans. The cans, which have already been precompacted by piston 22, will only need one stroke of piston 18 in order to achieve the desired density and size. At this point, the cans will be compressed beyond the intersection between the two chambers, to the bale position illustrated in FIGS. 1 and 2. The dimensions of the L-shaped cavity between the two chambers are such that, if the cavity is filled with cans compressed to the first predetermined compression pressure, and thus to a predetermined density, which is preferably of the order of $\frac{1}{3}$ of the final desired compression pressure and density, the weight of cans will be equal to the desired bale weight. Thus, no pre-weighing step is required in order to achieve the desired bale weight.

Once the desired compression pressure has been reached, the main actuator 20 is stopped, the door 28 is opened, and the actuator 20 is then actuated to advance piston 18 and push the formed bale 56 out of the chamber onto a suitable collector or transportation device, such as a conveyor, for example, as illustrated in FIG. 8. The piston 18 is then retracted ready for the next load of cans. The cruciform rib on piston head 18 produces a corresponding cruciform groove 72 on one face of the bale 56, which helps in binding the bales into larger stacks since ropes or straps can be held in the grooves 72 to reduce the risk of slipping.

This apparatus therefore uses the pressure required to compact the cans in order to produce a bale of the required dimensions and weight. This technique would not be accurate if cans of varying stages of compaction were compacted in a single step, since there would be no way of knowing if the correct weight of cans was being compressed. However, since the cans are first compacted into a cavity of predetermined dimensions until a first compression pressure is reached, the correct weight is ensured, and the second compression step achieves the required bale dimensions by compressing the cans until a second, higher compression pressure is reached. This also avoids the problems of performing the initial can compression with a relatively large capacity, slow moving hydraulic actuator. In one example, the smaller auxiliary actuator was used to compress the cans to about 15 lbs per cubic foot while the larger, main actuator subsequently compressed the cans to about 42 to 45 lbs per cubic foot, producing bales of predetermined dimensions and a weight of $42 \pm 2$ lbs.

Although in the preferred embodiment described above the apparatus is used for crushing cans, it may also be used for crushing other items such as plastic bottles, for example, or for compression of any compressible materials.

Although a preferred embodiment of the present invention has been described above by way of example only, it will be understood by those skilled in the field that modifications may be made to the disclosed embodiment without departing from the scope of the invention, which is defined by the appended claims.

I claim:

1. A can baling machine for forming cans into bales of predetermined size and weight, comprising:

an outer housing having an elongate main baling chamber and an elongate auxiliary baling chamber intersecting the main baling chamber to form a can receiving cavity at the intersection between the chambers;

the housing having an inlet opening for feeding cans into the can receiving cavity and a discharge opening at one end of the main baling chamber for discharging bales of crushed cans;

a door normally closing the discharge opening;

an auxiliary piston reciprocally mounted in the auxiliary chamber for movement between retracted and advanced positions in the auxiliary chamber, the advanced position being spaced from the intersection between the main and auxiliary chambers;

a main piston reciprocally mounted in the main baling chamber for movement between advanced and retracted positions, the portion of said main baling chamber between the main piston in said retracted position and the door being of predetermined dimensions;

auxiliary actuator means for moving the auxiliary piston back and forth in a series of compression strokes for applying an initial compaction to cans in the cavity to form a compacted mass of cans extending between the auxiliary and main baling chambers;

a first sensor device connected to said auxiliary actuator means for detecting when the can compressing pressure applied by said auxiliary piston reaches a predetermined first compression pressure;

main actuator means for moving the main piston back and forth to shear off the cans in the main baling chamber from the cans in the auxiliary chamber at the intersection between the chambers and to compress the cans in the main baling chamber until they are compacted into a bale of predetermined density and dimensions;

a second sensor device connected to said main actuator means for detecting when the can compressing pressure applied by said main piston reaches a predetermined second compression pressure; and control means connected to said sensor devices for controlling operation of said actuator means to reciprocate said auxiliary piston until said first compression pressure is reached and to subsequentially reciprocate said main piston until the second compression pressure is reached;

the predetermined dimensions of the portion of said main baling chamber being such that when cans filling said portion at said first compression pressure are compressed to said second compression pressure they will form a bale of said predetermined density and dimensions.

2. The machine as claimed in claim 1, wherein said actuator means each comprise a hydraulic cylinder and piston assembly, the cylinder of said main actuator being of larger volume than the cylinder of said auxiliary actuator.

3. The machine as claimed in claim 2, wherein the cylinder of said main actuator has a diameter of the order of 2.5 times that of said auxiliary actuator.

4. The machine as claimed in claim 1, wherein the inlet opening is perpendicular to both of said chambers.

5. The machine as claimed in claim 1, wherein said main piston is aligned with one side wall of said auxiliary chamber in said retracted position to form an L-shaped can receiving cavity.

6. A method of forming cans into a compressed bale of predetermined size and weight, comprising the steps of:

feeding cans into a can receiving cavity at the intersection of a main baling chamber with an auxiliary baling chamber such that the cans extend from the auxiliary baling chamber into the main baling chamber;

actuating a reciprocating, auxiliary piston in the auxiliary baling chamber to compress the cans in the cavity at the intersection until a compacted mass of cans at a predetermined first compression pressure is reached;

actuating a main piston in the main baling chamber to shear off the portion of the mass of cans in the main baling chamber from the portion in the auxiliary chamber at the intersection between the chambers and to compress cans in the main baling chamber towards a discharge end of the chamber until a predetermined second compression pressure greater than the first compression pressure is reached, the portion of the main baling chamber between the main piston and discharge end of the chamber being of predetermined dimensions such that when the cans at said first compression pressure filling said portion are compressed to said second compression pressure, they form a bale of predetermined size and density; and opening a discharge door at the discharge end of the main baling chamber and ejecting the bale from the baling chamber.

7. A can baling machine for forming cans into bales of predetermined size and weight, comprising:

an outer housing having first and second transverse baling chambers which intersect at a junction between the chambers to form a can receiving cavity;

a first piston reciprocally mounted in the first baling chamber for compressing cans in the cavity to a first predetermined compression pressure; and a second piston reciprocally mounted in the second baling chamber for shearing off the compressed cans in the second baling chamber from the cans in the first chamber at the junction between the chambers and compressing the sheared off cans in the second baling chamber to a second predetermined compression pressure;

said second piston comprising means for forming said cans into bales of predetermined size and weight.

* * * * *